US008292725B2

(12) United States Patent
Wikander

(10) Patent No.: US 8,292,725 B2
(45) Date of Patent: Oct. 23, 2012

(54) FANTASY SPORTS GAME AND METHOD OF CONDUCTING SAME

(75) Inventor: Peter Wikander, Northboro, MA (US)

(73) Assignee: Football Nation Holdings, LLC, Newton, MA (US)

( * ) Notice: Subject to any disclaimer, the term of this patent is extended or adjusted under 35 U.S.C. 154(b) by 288 days.

(21) Appl. No.: 12/841,402

(22) Filed: Jul. 22, 2010

(65) Prior Publication Data

US 2011/0021262 A1 Jan. 27, 2011

Related U.S. Application Data

(60) Provisional application No. 61/227,595, filed on Jul. 22, 2009.

(51) Int. Cl.
*A63F 9/24* (2006.01)

(52) U.S. Cl. ..... 463/20; 463/17; 463/18; 463/22

(58) Field of Classification Search ..... 463/20, 463/22, 17, 18
See application file for complete search history.

(56) References Cited

U.S. PATENT DOCUMENTS

| | | | |
|---|---|---|---|
| 4,918,603 | A | 4/1990 | Hughes et al. |
| 5,018,736 | A | 5/1991 | Pearson et al. |
| 5,263,723 | A | 11/1993 | Pearson et al. |
| 5,683,090 | A | 11/1997 | Zeile et al. |
| 5,713,793 | A | 2/1998 | Holte |
| 5,830,069 | A | 11/1998 | Soltesz et al. |
| 5,846,132 | A | 12/1998 | Junkin |
| 5,860,862 | A | 1/1999 | Junkin |
| 5,887,906 | A | 3/1999 | Sultan |
| 5,963,915 | A | 10/1999 | Kirsch |
| 5,971,854 | A | 10/1999 | Pearson et al. |
| 6,000,725 | A | 12/1999 | Nicolosi et al. |
| 6,004,211 | A | 12/1999 | Brenner et al. |
| 6,007,426 | A | 12/1999 | Kelly et al. |
| 6,024,640 | A | 2/2000 | Walker et al. |
| 6,135,881 | A | 10/2000 | Abbott et al. |
| 6,371,855 | B1 | 4/2002 | Gavriloff |
| 6,656,042 | B2 | 12/2003 | Reiss et al. |
| 6,669,565 | B2 | 12/2003 | Liegey |
| 6,773,350 | B2 | 8/2004 | Yoshimi et al. |
| 6,910,965 | B2 | 6/2005 | Downes |
| 7,001,279 | B1 | 2/2006 | Barber et al. |
| 7,225,233 | B1 | 5/2007 | Fenton |
| 7,357,715 | B2 | 4/2008 | Kane |

(Continued)

FOREIGN PATENT DOCUMENTS

WO WO2010/065305 6/2010

OTHER PUBLICATIONS

US 6,682,428, 01/2004, Yoshimi et al. (withdrawn)

(Continued)

*Primary Examiner* — Pierre E Elisca
(74) *Attorney, Agent, or Firm* — Wolf, Greenfield & Sacks, P.C.

(57) ABSTRACT

Disclosed and claimed herein is a sports fantasy game, having a roster of fantasy players for each user, and a slot machine-like apparatus that provides a limited number of spins for populating the roster of fantasy players. Also disclosed herein is a method of conducting the above described game. Further described and claimed are various modifications and enhancements.

22 Claims, 6 Drawing Sheets

U.S. PATENT DOCUMENTS

| | | | | |
|---|---|---|---|---|
| 7,364,509 | B2 | 4/2008 | Slade | |
| 7,458,891 | B2 | 12/2008 | Asher et al. | |
| 7,548,242 | B1 | 6/2009 | Hughes et al. | |
| 7,566,268 | B2 | 7/2009 | Asher et al. | |
| 7,566,270 | B2 | 7/2009 | Amaitis et al. | |
| 7,604,537 | B2 | 10/2009 | Amaitis et al. | |
| 7,614,944 | B1 | 11/2009 | Hughes et al. | |
| 7,618,312 | B1 | 11/2009 | Kasten | |
| 7,635,302 | B2 | 12/2009 | Wright | |
| 7,635,303 | B2 | 12/2009 | Wright | |
| 7,635,304 | B2 | 12/2009 | Wright | |
| 7,637,807 | B2 | 12/2009 | Asher et al. | |
| 7,637,809 | B2 | 12/2009 | Ghosh | |
| 7,641,549 | B2 | 1/2010 | Asher et al. | |
| 7,657,477 | B1 | 2/2010 | Chaffee | |
| 7,666,082 | B2 | 2/2010 | Kane et al. | |
| 7,666,084 | B2 | 2/2010 | Herrmann et al. | |
| 7,698,178 | B2 | 4/2010 | Chu | |
| 7,699,707 | B2 | 4/2010 | Bahou | |
| D615,885 | S | 5/2010 | Ng et al. | |
| 7,708,636 | B2 | 5/2010 | Asher et al. | |
| 7,716,113 | B2 | 5/2010 | Crosthwaite et al. | |
| 7,729,946 | B2 | 6/2010 | Chu | |
| 7,736,219 | B2 | 6/2010 | Gottlieb | |
| 7,985,134 | B2 * | 7/2011 | Ellis | 463/25 |
| 8,177,644 | B2 * | 5/2012 | Anderson et al. | 463/40 |
| 2006/0258438 | A1 * | 11/2006 | Platis | 463/25 |
| 2009/0149233 | A1 * | 6/2009 | Strause et al. | 463/7 |
| 2010/0285857 | A1 * | 11/2010 | Anderson et al. | 463/9 |
| 2012/0009984 | A1 * | 1/2012 | Amaitis et al. | 463/4 |

OTHER PUBLICATIONS

US 7,708,629, 05/2010, Wright (withdrawn)

* cited by examiner

Figure 5

501 502 503 504 505 506 507

| | Status | Today's Scoring | | | | | | | Prev. Pts. | Avg. Pts. | Retained % | Sought By |
|---|---|---|---|---|---|---|---|---|---|---|---|---|
| | | IP | HR | H | BB | K | Pts | | | | | |
| Starting Pitchers | Locked | | | | | | | | | | | |
| Tim Wakefield | | | | | | | | | 7 | 8 | 50 | 2 |
| Rich Hill | | | | | | | | | 8 | 4 | 22 | 0 |
| Derek Lowe | | | | | | | | | 5 | 10 | 67 | 5 |
| Relief Pitchers | Unlocked | | | | | | | | | | | |
| Brian Bruney | | | | | | | | | 5 | 4 | 75 | 7 |
| Ryan Franklin | | | | | | | | | 2 | 4 | 45 | 1 |
| Frank Francisco | | | | | | | | | 12 | 9 | 88 | 12 |
| | | 1B | BB+SB | 2B+3B | HR | K | Pts | | Prev. Pts. | Avg. Pts. | Retained % | Sought By |
| Middle Infielders | Posted | | | | | | | | | | | |
| Marco Scutaro | | | | | | | | | 8 | 9 | 54 | 4 |
| Jose Reyes | | | | | | | | | 4 | 14 | 88 | 6 |
| Julio Lugo | | | | | | | | | 11 | 3 | 23 | 0 |
| Corner Infielders/DH | Offer | | | | | | | | | | | |
| Ryan Howard | | | | | | | | | 12 | 17 | 90 | 22 |
| Travis Hafner | | | | | | | | | 23 | 4 | 78 | 1 |
| David Wright | | | | | | | | | 6 | 11 | 92 | 20 |
| Outfielders | Unlocked | | | | | | | | | | | |
| Ryan Ludwick | | | | | | | | | 7 | 8 | 65 | 3 |
| Mark Kotsay | | | | | | | | | 14 | 2 | 44 | 0 |
| Ryan Church | | | | | | | | | 22 | 9 | 88 | 1 |

FANTASY SPORTS GAME AND METHOD OF CONDUCTING SAME

RELATED APPLICATION/CLAIM OF PRIORITY

This application is related to and claims priority from provisional application Ser. No. 61/227,595, entitled "Method of Conducting a Fantasy Sports Game," filed Jul. 22, 2009, which provisional application is incorporated by reference in its entirety herein.

FIELD OF THE INVENTION

The present invention is in the field of recreation and gaming. More particularly, the present invention is in the technical field of fantasy sports games, which require a user to assemble and manage a roster of players who score points based on their performance in real-world events.

BACKGROUND

Fantasy sports games are ubiquitous in today's society. Leagues associated with fantasy games form in bars, at work, within families, and in neighborhoods and schools. Participants within individual leagues gather prior to the opening of the sports season and draft or auction teams of players. During the season, participants monitor the performance of their players and choose which players to keep active, which players to release, which players to acquire, and which players to trade. Fantasy sports providers generate revenue by providing advertising and/or charging team fees.

Traditional fantasy sports games don't create enough opportunities throughout the season for excitement, risk, and instant gratification—factors that entice the player to play more often. Fantasy sports users get the most excitement out of selecting a roster, making trades, and acquiring new "free agents." However, in traditional fantasy sports games, successful users are typically required to show patience and infrequently manage their roster for at least two reasons: 1) successful users tend to choose good players from the start, so there is little need to improve the players on the roster and 2) successful users understand that too much tweaking of the roster increases risk and limits the beneficial effects of long-term statistical regression to the mean. Even unsuccessful users are unlikely to actively play the game as often as they would like for at least three reasons: 1) the successful users have all the good players and their not willing to part with them, 2) unsuccessful users realize that they can benefit from the long-term statistical regression to the mean by keeping their roster stable, and 3) the likelihood of finding a quality players available or a willing trade partner is slim given that there are only so many real-world players to go around and only so many statistical categories that can be measured.

Since getting users to be actively involved in the game is what generates revenue (via advertising, transaction fees, data collection, related sales opportunities, or pay to play models), maximizing player engagement is good not only for the player, but for the game provider.

Other attempts have been made to increase player involvement: U.S. Pat. No. 6,656,042 describes an interactive fantasy lottery "where lottery players are given game pieces describing discernable actors (people, animals or events) who will be participating in an upcoming event." Lottery players could return to a Web site daily, to receive a new game piece. This gave the player something new every day, and introduced some degree of chance/excitement to obtaining a player, but it completely removed the skill involved in assembling a traditional fantasy roster. U.S. Pat. No. 6,371,855 describes a fantasy Internet sports game "that combines the entertainment of fantasy sports with the excitement of participating in an economic venture" by awarding value points based not only on player performance but on the value of those players. This invention rewarded a sophisticated assessment of risk and reward in assembling a roster, but it removed the excitement that comes from a more dynamic roster and the element of chance. In the field of lottery tickets—U.S. Pat. No. 5,887,906—describes combining the instant feedback of a scratch ticket with the personal intuition and ritual of playing one's numbers in a weekly lottery.

Nothing available in the field of fantasy sports today combines the advantages of traditional fantasy sports (using personal intuition and experience to manager your team) with a more exciting, fast-paced, casino-influenced game play. Therefore, there exists a need to provide a type of game play that offers instant and ongoing new content, interaction, and risk that rewards expert assessment without increasing the skill level required to play and while providing an incentive to play continuously.

SUMMARY

The present invention combines the type of skills required for fantasy sports with the variable interval reinforcement, ease of play, and constant excitement that have made slot machines the most popular games in American casinos and also adds a new component to fantasy gaming that is sure to draw interest; whereby the players that make up a user's roster must be evaluated collectively with one or more other players. This adds nuance to the assessment of players, balances risk and reward, and contributes to the sense of "Jackpot" that a user experiences after a successful spin. Users have only a limited number of spins and are forced to carefully consider the cost of an additional spin in relation to the expected value of the previous spin result.

The present invention describes a fantasy sports game and a method of conducting a fantasy sports game in which the user assembles a fantasy roster based on the results of a casino-style slot machine-like apparatus. According to this method of play, the result of each "play" on the slot machine-like apparatus is two or more fantasy players that the user can retain, discard, tweak, or trade to another user as a single entity. As nouns, the terms "play" and spin are used interchangeably herein and are used to denote a pull on the slot machine lever. In this invention, new rosters are acquired via this process on a regular basis.

BRIEF DESCRIPTION OF THE DRAWINGS

The various features, advantages and other uses of the present invention will become more apparent by referring to the attached drawings, in which:

FIG. 5 is a sample scorecard view detailing a user's lineup and related statistical data fields.

DETAILED DESCRIPTION

Herein, the conjunction "and" is intended to be inclusive and the conjunction "or" is not intended to be exclusive unless otherwise indicated. For example, the phrase "or, alternatively" is intended to be exclusive. Those who play the fantasy sports game are called "users." A "trading block" is a virtual space where users can trade player groupings.

Figure 1:
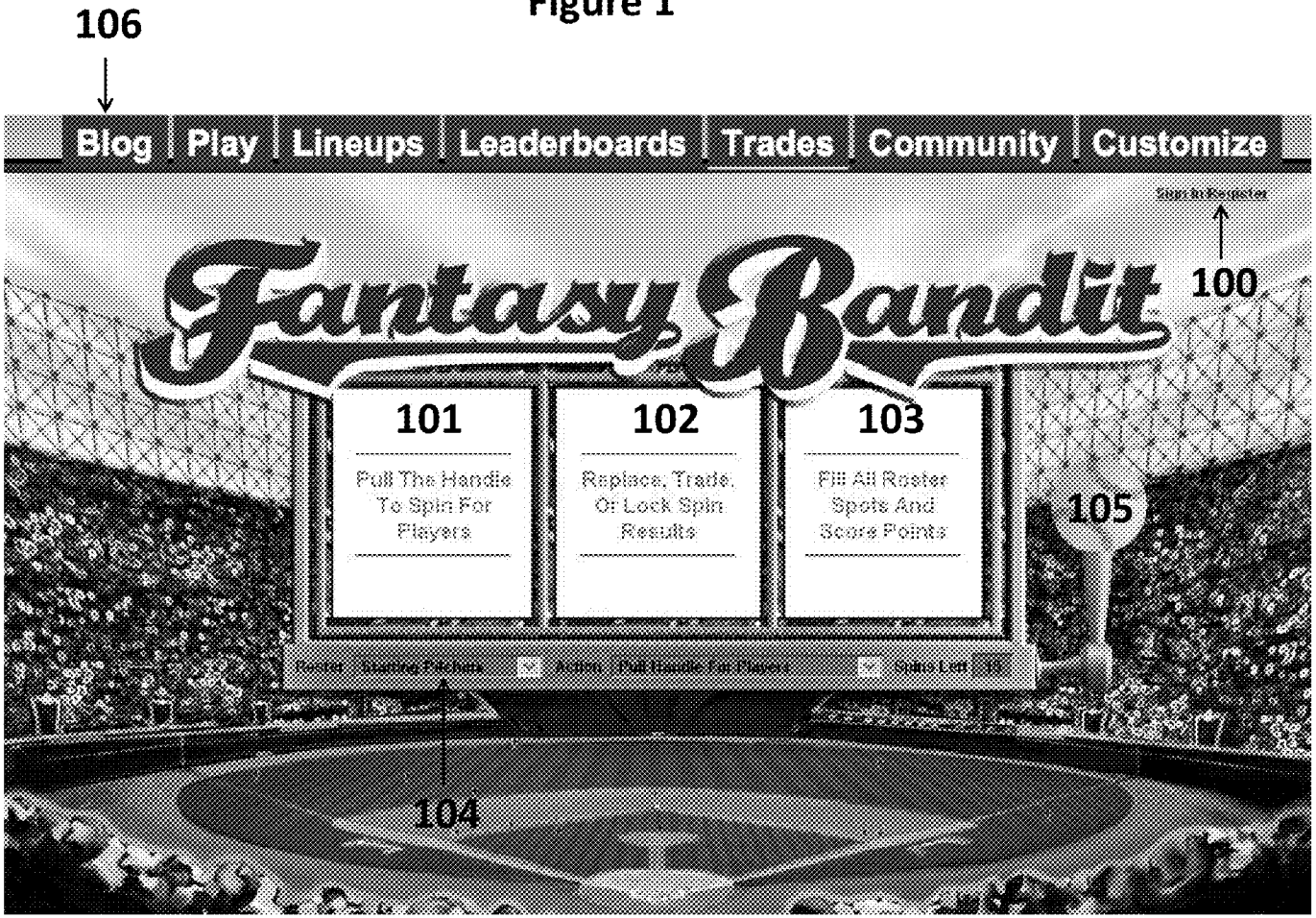
FIG. 1 is a representation of an online embodiment of the web-based master control of the invention before the user spins the dials.

FIG. 1 represents the Master Controller, or User Interface, for the present invention. This figure contains the slot-machine like apparatus that users use to build their rosters. In order to establish who the user is, and to associate him with his roster, the user must login to the game by clicking the Sign In/Register link, 100. There are three graphical dials in the center of the screen, 101, 102 and 103. These graphical dials represent the indicators for the players in a given position group as specified in a pull-down menu, 104. In addition, a handle on the right of the screen, 105, actuates the slot machine and produces one player in each of the graphical dials, 101, 102 and 103.

The player interacts further with an "Action" menu, 106. The Action Menu lists, for example, "Blog," "Play," "Line Ups," "Leader Boards," "Trades," "Comment," "Customize" and so on. Selection of one of these menu items instructs the Master Controller to go to that portion of the game. For example, selecting the "Trades" menu item allows the user to offer his or her position groups in the trading block or accept trade terms from other users.

Figure 2:
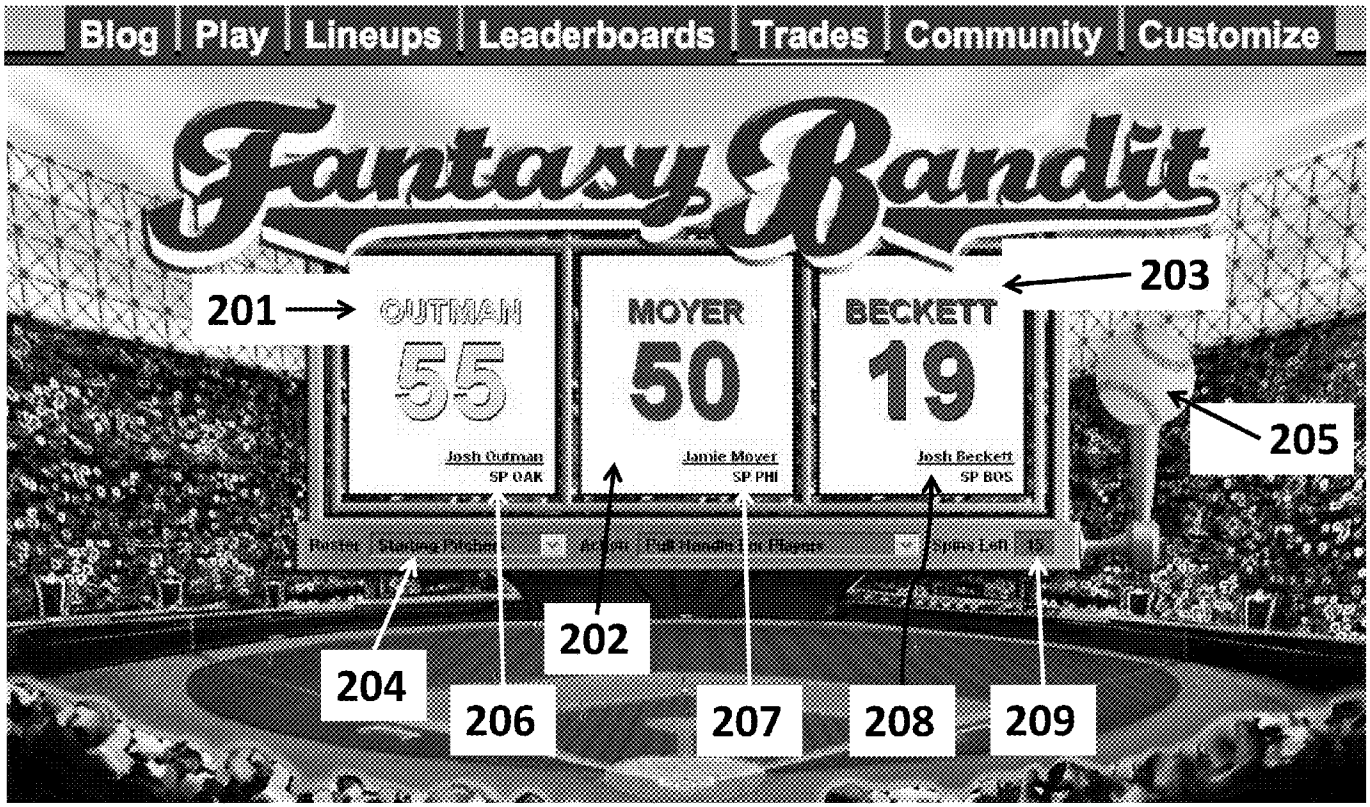
FIG. 2 is a representation of an online embodiment of the web-based master control after the user spins.

FIG. 2 once again shows the user interface, wherein a candidate list of players has been produced in the fantasy position group, as shown in windows 201, 202 and 203. To produce the list, the user interacts with the position group menu, 204, to select a particular position group and actuates the slot machine-like apparatus. For example, in a fantasy baseball game, the user might be attempting to populate the roster of "Starting Pitchers," as in the case of FIG. 2, "Relief Pitchers," "Corner Infielders" "Middle Infielders," and "Outfielders" with players most likely to score the most points in the game. When the player actuates the slot machine-like apparatus to produce a spin, the game retrieves from a database of players and statistics, three randomly selected fantasy players, 201, 202 and 203 with their associated statistics based on the selected position group, 204. Individual player statistics can be accessed by clicking on the names 206, 207 and 208. At this point, the user can decide to keep the grouping of players, trade the group of players, or spin again to retrieve a different random group of players. Each time the player spins, he or she loses a spin that could have been used to retrieve players for another position grouping wherein the number of remaining spins is recorded in the window labeled 209.

Figure 3:
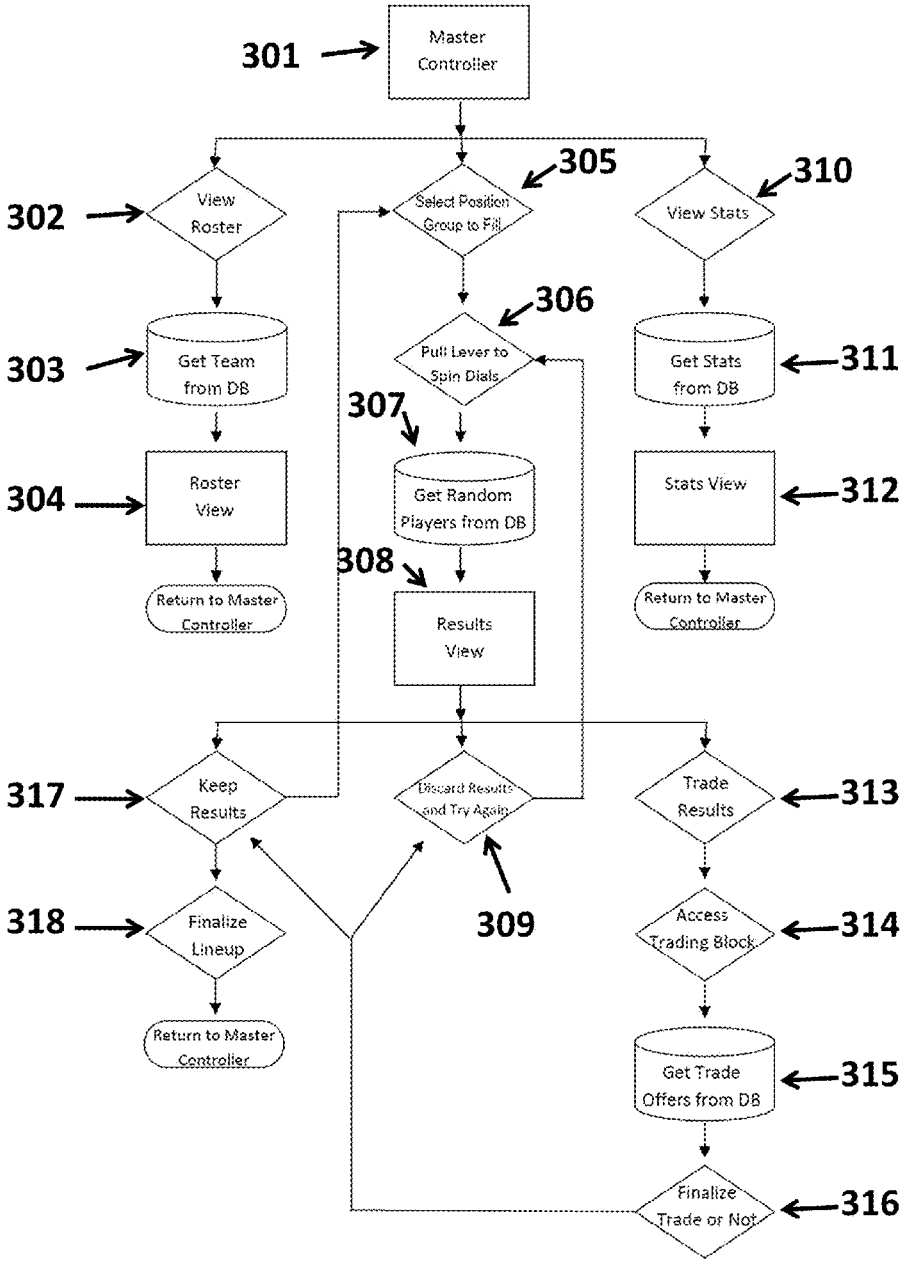
FIG. 3 is a flow chart depicting the game play routine, program logic and data retrieval.

As depicted in FIG. 3, the game operates by virtue of an associated software program, called a Master Controller, a database of fantasy players (for example, Major League Baseball players), and a statistical database such that it can keep track of the point totals associated with each fantasy player and, by association, each user. The Master Controller, 301, further provides the user interface, including the interface for the slot machine-like apparatus and the action menu.

Within the game logic of FIG. 3, the user can view his or her team roster, 302, which interface obtains roster data from the database, 303, and displays the data on the Roster View screen, 304. Further, within the game logic of FIG. 3, the user can select a position group to fill, 305, pull the lever on the slot machine-like apparatus, 306, to obtain a candidate list of players in that position group randomly from the database, 307, and view results, 308. The user can then decide to retain the results or discard the results and try again until all of his or her spins have been exhausted, 309.

Further, within the game logic of FIG. 3, the user can view his or her partial or complete team statistics, 310, by obtaining the statistics from the database, 311, and viewing them on the user interface, 312.

Further, within the game logic of FIG. 3, the user can decide to trade his or her results, 313, by accessing the trading block, 314, which gets the necessary data from the database, 315. Once the trade is described, the user can decide to finalize the trade or not, 316.

Further, within the game logic of FIG. 3, the user can decide to keep his or her results, 317, either based on one or more trades, 313-316, from the slot machine-like interface, 305-309. At this point, the user finalizes his or her lineup, 318.

Figure 4A:
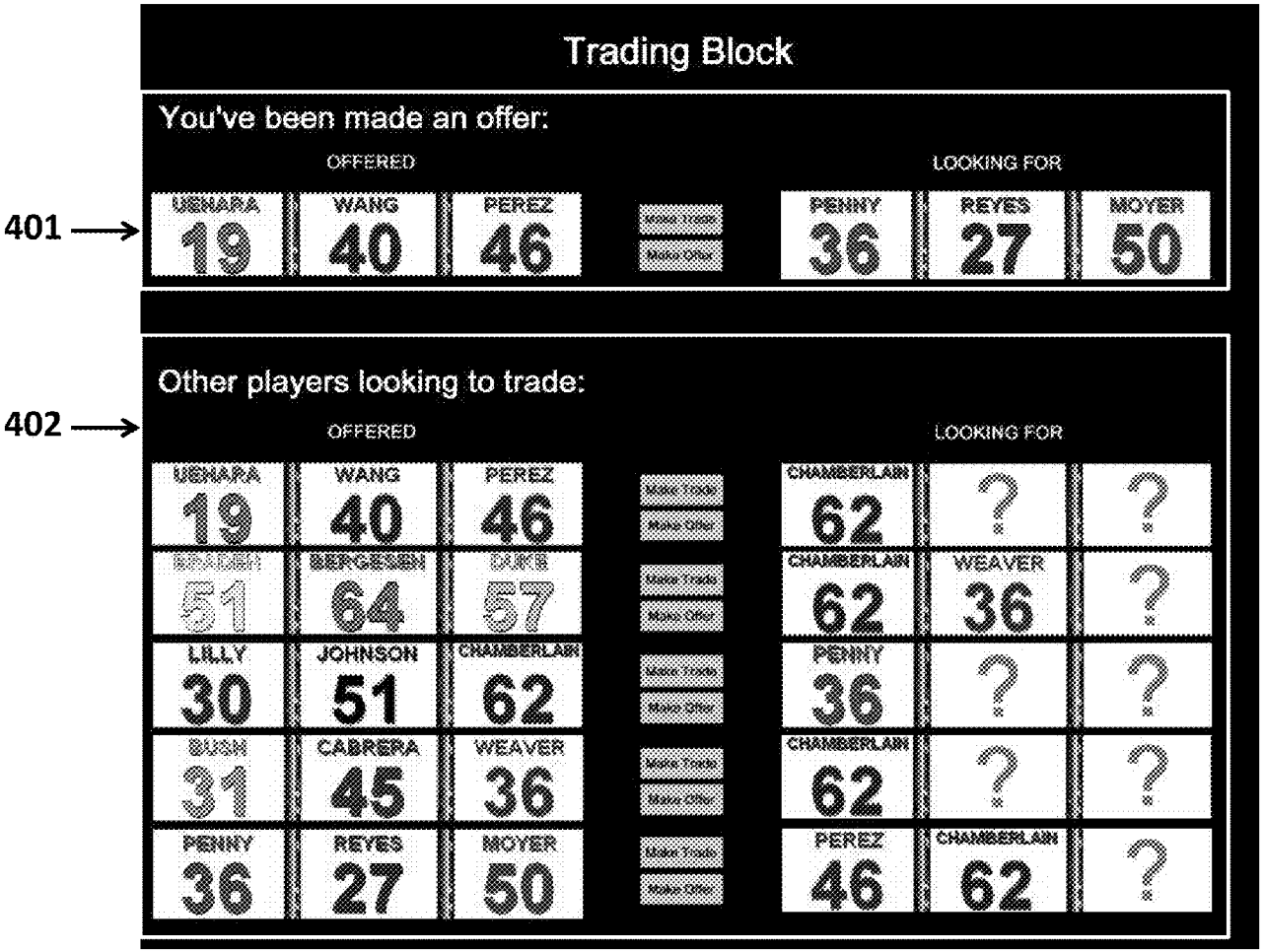
FIGS. 4(*a*) and 4(*b*) show examples of trading blocks for doing web-based trades; thus transforming the trade participant's team rosters.
Figure 4B:
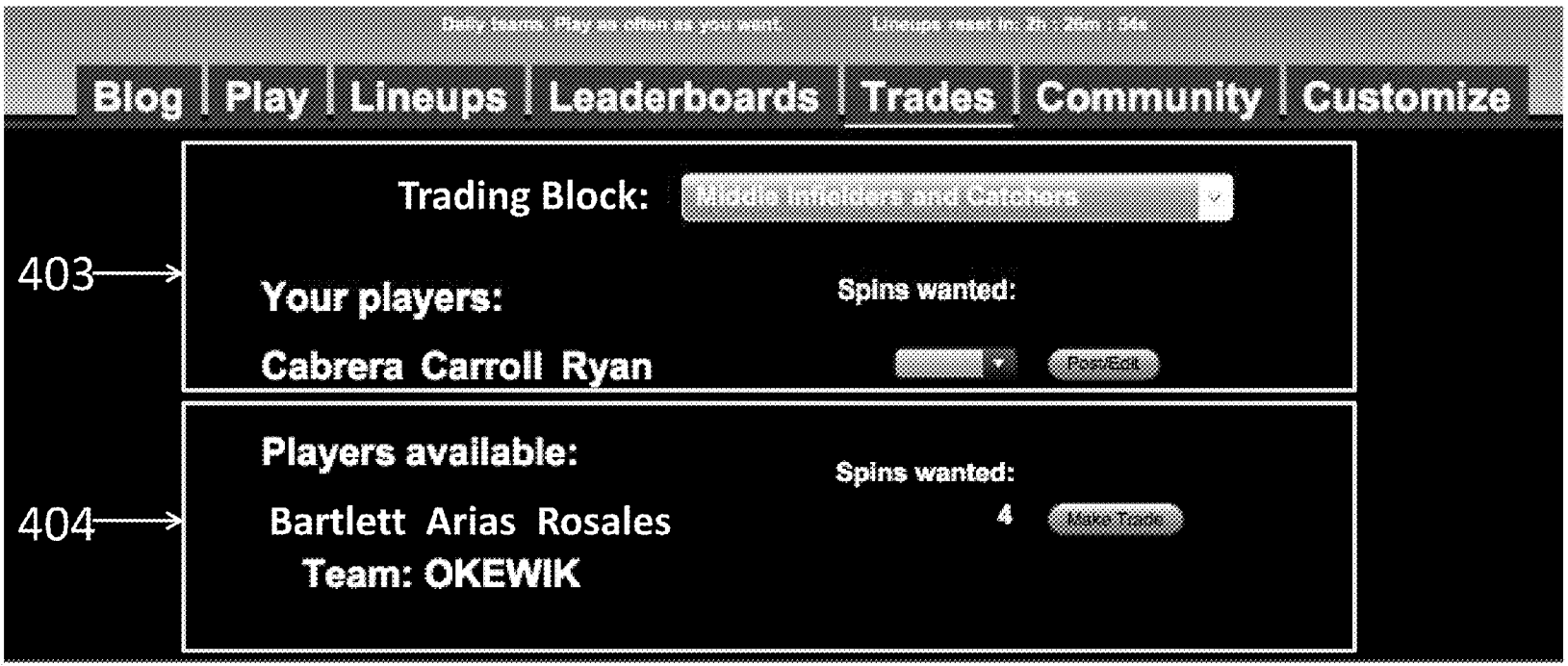

FIGS. 4(*a*) and 4(*b*) show the user interfaces for two possible trading mechanisms. A user can seek to trade or view offers for any of his or her player groupings.

FIG. 4(*a*) shows an example trading mechanism for a trading block in which players that have been offered for trade in exchange for other player groupings. For example, the active user is offering his or her player grouping, consisting of Uehara, Wang and Perez in exchange for a player grouping consisting of Penny, Reyes and Moyer, 401. Further, other players may make offers for a trade. For example, one user is offering Uehera, Wang, and Perez for any player grouping including Chamberlin, 402, without specifying the other players in the position group. Any user who has Chamberlin in his or her roster can accept the trade automatically. In this model mechanism, users looking to trade can be as specific as desired in terms of what they want in return for what they are offering: they can specify between 1 and 3 players that must be included in the incoming player grouping in order for the trade to qualify for automatic processing. Alternatively, users can make specific offers to specific teams. All offers and trade conditions are stored in the database.

FIG. 4(*b*) shows yet another example of a trading mechanism for a trading block in which players have been offered for trade in exchange for additional spins on the slot machine-like apparatus. In the top block, the current user is setting up a trade of his or her players in the position group "Middle Infielders and Catchers," 403, while another player has offered his or her players in that group and is requesting 4 additional spins on the slot machine-like apparatus in exchange, 404.

FIG. 5 shows one example of a scoreboard that might be used to tabulate scores for an individual user. Shown are the roster of players on the user's team, 501, the status of each position group, 502, a space for today's scoring in anticipation of an upcoming game, 503, previously scored points by the user's players in the past game, 504, the average points scored by all users in the past game, 505, the fraction of times a given player was retained, expressed as a numerical percent, 506 and the number of times a given player was sought by other users, 507.

The scoring mechanism involved in the fantasy game may be based on traditional methods of fantasy scoring and can be customized for specific games and league preferences. For example, for a fantasy baseball game, the scoring for batters might be as follows: single=1 point, double=2 points, triple=3 points, home run=4 points, steal=1 point, walk=1 point; for pitchers: points=innings−earned runs. This example scoring scheme may be applied to a real sports game played after all users have had an opportunity to populate their teams or it might be applied to an imaginary game in which past player statistics are used to model an outcome of one or more plays within the game or the entire game based on random numbers.

In the case of an imaginary game, statistical parameters such as means, modes, medians, distributions, spreads such as standard deviations, correlation coefficients, F statistics, t statistics and the like may be used to calculate the modeled data for a given play or for the whole game. In this way, user scores might be obtained more frequently.

Further, in order to add excitement and challenge to the game, points might be scored based on the fractional number of times a player is retained in a roster, expressed as a numerical percent rounded to the nearest integer (Retained %) or the number of times users sought to make a trade for a given player (Sought By). These parameters may contribute to the score additively or may be subjected to some algorithm that calculates their contributions to the score. In any case, this information is retained in the database and may be useful for future statistical analysis for internal or external consumption.

Therefore, according to a first broad aspect, the present application discloses and claims a sports fantasy game for one, two or more users, comprising: a roster of fantasy players for each user, said roster comprising a plurality of fantasy position groups, and a slot machine-like apparatus that provides a limited number of spins for populating the roster of fantasy players, wherein each spin produces a grouping of two or more fantasy players chosen randomly from a database of fantasy players and associated statistics, wherein said grouping populates a fantasy position group in the roster or, alternatively, wherein said grouping is replaced by a new grouping after a subsequent spin by the user, and wherein the fantasy players and statistics are chosen from a database of a preselected sport.

According to a second broad aspect, the present application discloses and claims a method of conducting a sports fantasy game for one, two or more users, comprising: providing a roster of fantasy players for each user, said roster comprising a plurality of fantasy position groups, and providing a slot machine-like apparatus that provides a limited number of spins for populating the roster of fantasy players, wherein each spin produces a grouping of two or more fantasy players chosen randomly from a database of fantasy players and associated statistics, wherein said grouping populates a fantasy position group in the roster or, alternatively, wherein said grouping is replaced by a new grouping after a subsequent spin by the user, and wherein the fantasy players and statistics are chosen from a database of a preselected sport.

According to a third broad aspect, the present application discloses and claims a sports fantasy game for one, two or more users, comprising: a roster of fantasy players for each user, said roster comprising a plurality of fantasy position groups, and a player selector comprising a random number generator, wherein said player selector provides a limited number of opportunities to be taken by the user for populating the roster of fantasy players, wherein each opportunity produces a grouping of two or more fantasy players chosen at random from a database of fantasy players and associated statistics, wherein said grouping populates a fantasy position group in the roster or, alternatively, wherein said grouping is replaced by a new grouping after a subsequent opportunity taken by the user, and wherein the fantasy players and statistics are chosen from a database of a preselected sport.

Various enhancements of the present invention are contemplated. For example, the game can be played by one user whose score might then be compared to a preset standard such as an average, or a previous high score. In another enhancement, the database of fantasy players and associated statistics can comprise a list of players chosen from professional or non-professional players. In another enhancement, a sports fantasy game can have a trading block for transforming the roster of fantasy players, wherein a user can trade a grouping of two or more fantasy players to other users (if any). If no other users are playing the game, the trading block would not operate or, alternatively, could support trades with a virtual user provided by the game. In another enhancement, the trading block could provide a place where the user can trade a grouping of two or more fantasy players in his or her roster to another user in exchange for a grouping of two or more fantasy players in the other user's roster or, the trading block could provide a place where a user can trade a grouping of two or more fantasy players in his or her roster to another user in exchange for an agreed-upon number of spins. In another enhancement, the game of this invention can comprise a mechanism for computing a score for each user in the sports fantasy game, wherein the score comprises (a) the retained percentage for each fantasy player, and optionally, (b) the number of users looking to trade for each fantasy player in the roster. In another enhancement, the sports fantasy game can be delivered online via a web site. In another enhancement, the sports fantasy game can comprise a means for generating revenue. In another enhancement, the sports fantasy game can be adapted to be played in a hospitality establishment. These enhancements can be applied singly or, where appropriate, in combination.

Random number generators can be based on several algorithms. Among these are linear congruential generators, add-with-carry and subtract-with-borrow generators, multiply-with-carry generators, and inversive conguential generators.

A slot machine-like apparatus can be a mechanical device or a virtual device comprising a random number generator or mechanical means of generating a random outcome such as might be found in a conventional mechanical slot machine.

The database of players and associated statistics can, for example, be acquired from a trustworthy third-party source or maintained on the same servers as the software program that represents the present invention. Alternatively, the database of players and associated statistics can be kept by a local or regional organization such as a league of professional or non-professional players of any sport or organized games such as Olympic games.

The database of players and associated statistics can be kept on players of sports such as baseball, football, basketball, hockey, soccer, lacrosse, curling, roller derby, bowling, other olympic sports, cricket, polo and other team competitive sports.

The game of the present invention can be adapted to be delivered via a web site, a hand-held device, in a hospitality venue such as a bar, a casino, a restaurant, a hotel room, a stadium box, a betting parlor or the like. It is contemplated that the game interface can be adaptable to the method of presentation. For example, when the game is delivered via a web site, a keyboard may be available. On the other hand, a simpler set of controls would be sufficient for game machines adapted to be used in casinos.

Means for generating revenue include pay-for-play of a single game, pay-per-spin, pay-per-trade, side wagering with vigorish assessed as a percentage or as a flat fee, side bets on other users' results, with a vigorish charged, advertising on the user interface, sales of branded sports paraphernalia through the game, controlled house percentages, associated broadcast advertising on sports programs covered by the game and the like.

In that the preceding description of the present invention discloses only exemplary embodiments thereof, it is to be understood that other variations are contemplated as being within the scope of the present invention. While the present invention has been described within the context of a Web site hosted on a Web server with content related to baseball players, it is to be understood that the particular content of the game is not meant to be limiting.

What is claimed is:

1. A sports fantasy game, comprising:

a. a roster of fantasy players for each user, said roster comprising a plurality of fantasy position groups, and b. a slot machine-like apparatus that provides a limited number of spins for populating the roster of fantasy players, wherein each spin produces a grouping of two or more fantasy players chosen randomly from a database of fantasy players and associated statistics, wherein said grouping populates a fantasy position group in the roster or, alternatively, wherein said grouping is replaced by a new grouping after a subsequent spin by the user, and wherein the fantasy players and statistics are chosen from a database of a preselected sport.

2. The sports fantasy game of claim 1, wherein the database of fantasy players and associated statistics comprises a list of players chosen from professional or non-professional players.

3. The sports fantasy game of claim 1, further comprising a trading block for transforming the roster of fantasy players, wherein a user can trade a grouping of two or more fantasy players to other users.

4. The sports fantasy game of claim 3, wherein the trading block provides a place where the user can trade a grouping of two or more fantasy players in his or her roster to another user in exchange for a grouping of two or more fantasy players in the other user's roster.

5. The sports fantasy game of claim 3, wherein the trading block provides a place where a user can trade a grouping of two or more fantasy players in his or her roster to another user in exchange for an agreed-upon number of spins.

6. The sports fantasy game of claim 3, further comprising a mechanism for computing a score for each user in the sports fantasy game, wherein the score comprises a. the retained percentage for each fantasy player, and optionally, b. the number of users looking to trade for each fantasy player in the roster.

7. The sports fantasy game of claim 1, wherein the sports fantasy game is delivered online via a web site.

8. The sports fantasy game of claim 1, wherein the sports fantasy game further comprises a means for generating revenue.

9. The sports fantasy game of claim 1, wherein the sports fantasy game is adapted to be played in a hospitality establishment.

10. A method of conducting a sports fantasy game, comprising:

a. providing a roster of fantasy players for each user, said roster comprising a plurality of fantasy position groups, and b. providing a slot machine-like apparatus that provides a limited number of spins for populating the roster of fantasy players, wherein each spin produces a grouping of two or more fantasy players chosen randomly from a database of fantasy players and associated statistics, wherein said grouping populates a fantasy position group in the roster or, alternatively, wherein said grouping is replaced by a new grouping after a subsequent spin by the user, and wherein the fantasy players and statistics are chosen from a database of a preselected sport.

11. The method of conducting the sports fantasy game of claim 10, wherein the database of fantasy players and associated statistics comprises a list of players chosen from professional or non-professional players.

12. The method of conducting the sports fantasy game of claim 10, further comprising a trading block for transforming the roster of fantasy players, wherein a user can trade a grouping of two or more fantasy players to other users.

13. The method of conducting the sports fantasy game of claim 12, wherein the trading block provides a place where the user can trade a grouping of two or more fantasy players in his or her roster to another user in exchange for a grouping of two or more fantasy players in the other user's roster.

14. The method of conducting the sports fantasy game of claim 12, wherein the trading block provides a place where a user can trade a grouping of two or more fantasy players in his or her roster to another user in exchange for an agreed-upon number of spins.

15. The method of conducting the sports fantasy game of claim 12, further comprising a mechanism for computing a score for each user in the sports fantasy game, wherein the score comprises a. the retained percentage for each fantasy player, and optionally, b. the number of users looking to trade for each fantasy player in the roster.

16. The method of conducting the sports fantasy game of claim 10, wherein the sports fantasy game is delivered online via a web site.

17. The method of conducting the sports fantasy game of claim 10, wherein the sports fantasy game further comprises a means for generating revenue.

18. The method of conducting the sports fantasy game of claim 10, wherein the sports fantasy game is adapted to be played in a hospitality establishment.

19. A sports fantasy game, comprising:

a. a roster of fantasy players for each user, said roster comprising a plurality of fantasy position groups, and b. a player selector comprising a random number generator, wherein said player selector provides a limited number of opportunities to be taken by the user for populating the roster of fantasy players, wherein each opportunity produces a grouping of two or more fantasy players chosen at random from a database of fantasy players and associated statistics, wherein said grouping populates a fantasy position group in the roster or, alternatively, wherein said grouping is replaced by a new grouping after a subsequent opportunity taken by the user, and wherein the fantasy players and statistics are chosen from a database of a preselected sport.

20. The sports fantasy game of claim 19, wherein the trading block provides a place where the user can trade a grouping of two or more fantasy players in his or her roster to another user in exchange for a grouping of two or more fantasy players in the other user's roster.

21. The sports fantasy game of claim 19, wherein the trading block provides a place where a user can trade a grouping of two or more fantasy players in his or her roster to another user in exchange for an agreed-upon number of spins.

22. The sports fantasy game of claim 19, further comprising a mechanism for computing a score for each user in the sports fantasy game, wherein the score comprises a. the retained percentage for each fantasy player, and optionally, b. the number of users looking to trade for each fantasy player in the roster.

* * * * *